US005077976A

United States Patent [19]

Pusic et al.

[11] Patent Number: 5,077,976

[45] Date of Patent: Jan. 7, 1992

[54] STIRLING ENGINE USING HYDRAULIC CONNECTING ROD

[76] Inventors: Pavo Pusic, 164 McKinley Ave., East Hanover, N.J. 07936; Bozo Memed, Balda McKisica 3, 50000 Dubrovnik,

[21] Appl. No.: 570,806

[22] Filed: Aug. 22, 1990

[51] Int. Cl.[5] ..... F02G 1/044; F02G 1/053; F02B 75/32

[52] U.S. Cl. ..... 60/525; 123/197.3

[58] Field of Search ..... 60/517, 525; 92/52, 92/61, 146

[56] References Cited

U.S. PATENT DOCUMENTS 1,560,492 11/1925 Powell ..... 92/52 X
3,878,681 4/1975 Hakansson ..... 60/517
4,966,109 10/1990 Pasic et al. ..... 123/197 AB

*Primary Examiner*—Allen M. Ostrager
*Attorney, Agent, or Firm*—Marks Murase & White

[57] ABSTRACT

A Stirling engine having a configuration which allow spatial separation of the heaters and coolers. The engine includes four cylinders with passageways connecting the cylinders such that a direct fluid connection is formed between each cylinder and every other cylinder. The configuration of the passageways and arrangement of the cylinders is such that heat energy is not wasted. The spatial separation of the heaters and coolers allows the heaters and coolers to be located in separate environments. The pistons within each cylinder are connected to one or two crankshafts through a connecting device which generates no side thrust on the cylinder walls. Preferably, the connecting device used is a hydraulic connecting rod.

18 Claims, 7 Drawing Sheets

STIRLING ENGINE USING HYDRAULIC CONNECTING ROD

This application is a continuation-in-part of U.S. application Ser. No. 07/333,685 filed on Apr. 5, 1989, now U.S. Pat. No. 4,966,109.

1. Field of the Invention

The present invention relates to Stirling engines. The present invention further relates to Stirling engines used to convert solar energy into usable mechanical or electrical energy. The present invention also relates to a Stirling engine which uses a connecting rod to provide a mechanical connection between the pistons of a Stirling engine and a crankshaft.

2. Background of the Invention

The Stirling engine, invented by Robert Stirling and first built in 1816 offers a number of advantages over internal combustion engines; these include virtually no oil consumption, long service life, relative silence, a high thermal efficiency potential of 40–45% at part load, acceptance of various fuels and a clean exhaust. Notwithstanding these advantages, the Stirling engine has yet to be widely accepted.

In a kinematic "Stirling cycle" engine, the pistons are connected to a crankshaft to provide mechanical power and to operate a rotating alternator. In a free piston "Stirling cycle" engine, the piston travels freely back and forth and a linear alternator can be built into the piston to produce electricity from this motion. Both kinematic and free piston Stirling cycle engines have their drawbacks which do not allow optimal utilization of heat. Since the piston(s) in a Stirling cycle engine have to perform frictionless reciprocating motion inside the cylinder(s), the linear piston movement in known kinematic engines has to be converted into rotary motion of the crankshaft with either a rhombic drive or a swash plate. Both solutions do not allow optimal utilization of the force exerted by the piston(s) and result in a significant decrease in torque produced on the crankshaft.

In a free piston Stirling cycle engine, linear alternators are the best solution to convert piston movement into electrical current. Since linear alternators have a much lower efficiency ratio than rotating alternators, this solution also does not provide optimal utilization of the force produced by expanding gas.

Therefore, it is an object of the present invention to provide an engine which will enable the highest possible utilization of energy of expanded gas by minimizing loads which oppose the resultant force and produce energy losses.

Solar energy is an immense and inexhaustible source of power; it is the most promising energy of the future. Every year about 1,000 times more energy reaches the earth's surface from the sun than could be produced by burning all the fossil fuels mined and extracted that year.

Presently, two of the most important ways to exploit solar energy are its exploitation through heat and by producing electricity. Of these, producing electricity from solar energy seems to be the most promising application. The two principal ways of producing electricity from a solar source are photovoltaic solar cells and external combustion engines. The photovoltaic (PV) solar cells directly convert the stream of photons that make up light into a stream of electrons that make up an electrical current and are capable of reaching over 30% efficiency. The main drawback with the most efficient PV solar cells, such as gallium arsenide (GaAs), is cost which, at today's level, makes electricity from this source about five times more expensive than electricity produced from coal, about three 3 times more expensive than electricity produced from oil and natural gas, and at least two times more expensive than electricity from solar-thermal plants.

Furthermore, solar cells generate direct electrical current (DC) which for practical use has to be converted to alternating current (AC). This "power-conditioning" accounts for about 20% of the cost of electricity generated by a typical solar cell.

Therefore, for the immediate future, the most promising technologies are those which generate electricity from the temperature gradients caused by solar thermal energy; of these, combustion motors that use the "Stirling cycle" are among the most efficient for generating electricity from sunlight. Engines based on the "Stirling cycle" are efficient in both small and large scale installations, easy to install, clean, and generate alternating electrical current. Since the temperature generated by solar reflectors which heat expanding gas inside the cylinder is very high, the piston in an engine utilizing the "Stirling cycle" can be set moving with great force. Thus, it is believed that Stirling engines are an ideal mechanism for harnessing solar energy. In fact, it is contemplated that Stirling engines will be used to power space satellites and space stations. It can be appreciated, however, that the aforementioned drawbacks with presently available Stirling engines have adversely affected the use of Stirling engines to convert solar energy.

SUMMARY OF THE INVENTION

The process of the present invention is made possible by the process of my invention described in a patent application entitled Hydraulic Connecting Rod filed on Apr. 5, 1989 (Ser. No. 07/333,685) and allowed by U.S. Patent Office on May 24, 1990.

The connecting rod of the present invention is designed such that the resultant load of the force produced by engine piston reciprocating motion is increased without enlarging piston or cylinder size or increasing fuel consumption. The connecting rod of the present invention comprises two hydraulic pistons having different diameters (located in two hydraulic cylinders) which will develop equal torque on the crankshaft while having shorter crankshaft throw and, therefore, cause centrifugal and inertia loads to decrease. Since the force developed by combustion pressure, which acts along the connecting rod, is decreased by centrifugal and inertia loads, the decrease of these loads will result in an increase of the resultant or effective load.

The smaller hydraulic piston is built on, i.e., connected to, the engine piston and the larger hydraulic piston is built on, i.e., connected to, the crankshaft side of the hydraulic connecting rod. According to the process of the present invention, the force exerted on the smaller piston is increased when exerted on the larger piston by the fluid located between the two hydraulic pistons. According to the law of hydraulics which requires that the force per unit area exerted by the smaller piston on the fluid and the force per unit area exerted by the fluid on the larger piston be the same, the total force exerted on the larger piston is many times the total force exerted by the smaller piston. For example, if a pressure of 10 lbs. is applied to a smaller piston, that has an area of 4 sq. inches, the same pressure transmitted on a larger piston, that has an area of 8 sq. inches, would result in a total force exerted on the larger piston of 20 lbs. As the volume of fluid displaced by each piston is the same, the smaller piston is forced to a depth which is proportionally longer than the depth of the large piston according to the ratio of their diameters. In other words, the smaller piston travels a proportionately greater distance so that work (force x distance) remains constant. Since the larger piston (which is connected to the crankshaft) travels a shorter distance the diameter of the crankshaft throw rotating motion is shortened in proportion to the pistons' diameter ratio. For example, if the ratio of the piston head areas of the two hydraulic pistons is 1:2, the crankshaft throw rotating motion diameter will be two times shorter than (one half) the engine piston reciprocating motion diameter.

Because of the shorter crankshaft throw, a proportionally smaller counterweight is needed to offset the eccentric masses of metal in the crankshaft throw. As a result of the shorter crankshaft throws and the use of smaller counterweights, centrifugal and inertia loads are significantly diminished and total crankshaft weight is decreased. Under a given set of conditions, the centrifugal load of rotating crankshaft throw and counterweight decreases proportionally to a decrease in throw and counterweight radius. Also under a given set of conditions, the inertia load of a rotating throw and counterweight decreases by a factor of four when the throw and counterweight are two times shorter (shorter by a factor of two). Therefore, during the piston's power stroke, the resultant load of the combustion pressure, acting along the connecting rod, will increase and the engine will accelerate and slow down much easier. Since transmitting the force through the hydraulic fluid results in less vibration in the engine, the flywheel mass will also decrease causing the total centrifugal and inertia loads to further decrease. Consequently, the total crankshaft torque will significantly increase.

For example, if the ratio of the piston head areas of the two hydraulic pistons is 1:2, the force exerted on the smaller piston by the engine piston will be increased two times when exerted on the bottom end of the larger piston's connecting rod which is mounted on the crankshaft throw, assuming that no significant friction loss occurs between the two said points of exertion. Since the crankshaft throw rotating diameter in this case is only half of the engine piston's reciprocating motion diameter, the crankshaft torque will equal the torque obtained using a connecting rod of the type known in the prior art during the piston power stroke. During the engine piston's upward stroke, the force exerted by the crankshaft throw on the bottom end of the larger hydraulic piston connecting rod is two times smaller when exerted on upper end of the smaller hydraulic piston and equals the force provided when a prior art connecting rod is used.

The use of a hydraulic connecting rod in a Stirling cycle engine enables translation of the linear reciprocating motion of the piston(s) into a rotating motion of the crankshaft without causing any side thrust on the piston(s) or decreasing the resultant load of the force exerted by the piston. Further, the reduced crankshaft throw allows the rotating diameter of the crankshaft rod journals to be decreased with respect to the piston stroke and, consequently, inertial and centrifugal loads and loses can be kept at a minimum regardless of the engine size (length of piston stroke).

In the case of a Stirling engine, the use of a hydraulic connecting .rod will also make it possible to use a significantly smaller engine piston which will produce significantly smaller inertial load and loss. Relatively large pistons are required in existing double-acting Stirling engines because a slight side thrust is exerted on them by their connecting rods.

In accordance with the present invention a double-acting piston is connected to a hydraulic connecting rod which translates linear motion of the piston into rotary motion of the crankshaft. In this way, the present invention achieves optimal utilization of the force developed by the expanding gas by using this force to operate a highly efficient rotating alternator without producing the losses associated with existing kinematic Stirling cycle engines.

It is yet another object of the present invention to provide an engine particularly suited for conversion of solar energy into electric energy. The present invention is intended to provide a Stirling cycle process which will eliminate drawbacks associated with Stirling cycle engines known in the prior art. The present invention does not require a buffer gas, a rhombic drive, and a displacer piston all of which are typically required for rhombic drive engines, nor does it require a swash plate and the energy inefficient process typical for double-acting Stirling engines. The heaters, manifolds, and coolers of the Stirling engine of the present invention have a very simple physical configuration which will enable solar energy collected by reflecting dishes to be transmitted and converted into useful force almost with virtually no thermal losses. Also, the dead volume of the engine will be significantly decreased in comparison to engines known in the prior art.

According to the process of the present invention, the double-acting pistons of the Stirling engine will simultaneously create both compression and vacuum resulting in the highest possible power output. Due to the process and simple configuration of the present invention, the energy loss required for cooling purposes will be kept at minimum.

Furthermore, since the present invention produces rotating motion (as opposed to linear motion), it also makes it possible to use cost-effective and energy efficient means for energy storage. For example, through the use of a set of flywheels and transmission means, excess kinetic energy obtained during peak temperatures can be efficiently stored and used when required. Since the intensity of solar energy on earth (outside of tropical areas) is in reality almost constantly changing, it follows that a solar powered Stirling engine would produce different engine operating speeds. This, in turn, would result in different alternator operating speeds. Storage of the excessive amount of electric energy results in a significant waste of energy which, for example, in the case of linear alternator cannot be avoided because of the Law of Entropy.

By using a set of electronically controlled transmission gears, the excess kinetic energy produced during any peak heat period can be efficiently stored in the form of a flywheel rotation. In this way, the alternator rotating speed can be kept at a constant level. In one example, the amount of force produced by the engine which exceeds the amount of force required for a certain predetermined alternator rotating speed is transmitted to the flywheel. The force is transmitted back to the alternator when required to maintain the required level of alternator rotating speed. This type of energy storage will be particularly suitable for small-scale installations and during partly cloudy weather.

Moreover, since the engine of the present invention can be used to operate a rotating alternator, it is compatible with any other engine and turbine used for generating electrical energy through rotating means. For example, a single rotary alternator can be operated by solar energy when applicable and by some other power unit when solar energy does not provide enough power. Ideally, since the present invention makes it possible to eliminate centrifugal and inertia losses regardless of the piston stroke length, a giant engine could be installed for the purpose of operating a rotating alternator. Such an engine can be heated with heat from solar reflecting dishes and cooled by running water since, in accordance with an important aspect of the present invention, its configuration provides heaters above the cylinders and coolers along the lower sections or below the cylinders.

As mentioned above, it is believed that Stirling cycle engines will be used to power space satellites and space stations. With large reflectors to gather heat from the sun and a large radiator to radiate the heat away, such an engine could operate without any fuel at all. The physical configuration of the present invention, especially the spatial separation of the heaters and coolers, could make such a process extremely efficient.

Despite the fact that the preferred embodiment of the present invention illustrates an engine which is preferably powered by solar energy, it is to be understood that this invention can be powered by any heat source, for example, the heat produced from the continuous combustion of a fuel, such as kerosene or oil. Therefore, it can be used as a power plant in different types of vehicles.

The features and advantages of the present invention will become apparent from the following brief description of drawings and description of the preferred embodiment.

DETAILED DESCRIPTION

As mentioned above, the present invention is made possible by the invention described in the inventor's previous application entitled "Hydraulic Connecting Rod." Since the adaptation of hydraulic connecting rod technology to Stirling engines is, along with the physical configuration of the Stirling engine, one of the principal aspects of the present invention, it is believed appropriate to begin with a detailed description of a hydraulic connecting rod as used as a substitute for the well known connecting rod in an internal combustion engine. This will make it easier to understanding the use of hydraulic connecting rods in a Stirling engine.

Figure 1:
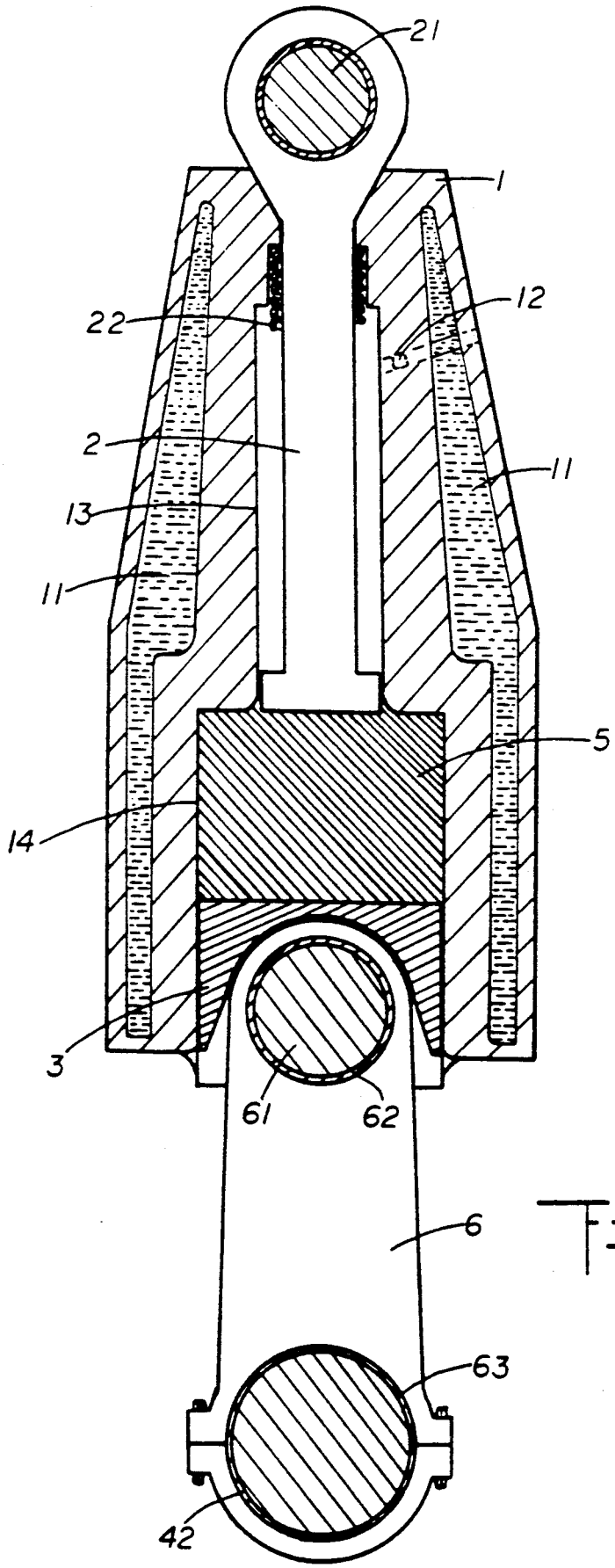
FIG. 1 is the side cutaway view of a hydraulic connecting rod according to the present invention applied to an internal combustion engine.

Referring to FIG. 1, there is shown a hydraulic connecting rod comprising hydraulic cylinder housing 1, smaller hydraulic piston 2, hydraulic fluid 5, larger hydraulic piston 3 and lower connecting rod 6. The hydraulic cylinder housing 1 comprises smaller 13 and larger 14 hydraulic cylinders, wherein hydraulic fluid 5 is located between said pistons 2 and 3 and wherein reciprocating motion of said pistons 2 and 3 is performed. The fluid 5, shown in all figures as shaded areas, is of an incompressible frictionless type and is displaced up and down through the smaller 13 and larger 14 cylinder by smaller piston 2 and larger piston 3. Displacement of the fluid 5 from the smaller cylinder 13 always equals the length of the engine piston's 7 stroke and displacement from the larger cylinder 14 always equals the length of the crankshaft throw 42 rotating motion diameter which depends on the diameter ratio of the two hydraulic pistons 2 and 3. The smaller hydraulic piston 2 is a solid cylindrically shaped pin which is connected at its upper end to the engine piston 7 by a piston pin 21. The larger hydraulic piston 3 is a cup-shaped, cylindrical casting which is connected to the lower connecting rod 6 by a piston pin 61 (located inside a bearing 62). The lower connecting rod 6 is mounted on a bearing 63 which is mounted connected on the crankshaft throw 42.

Figure 2:
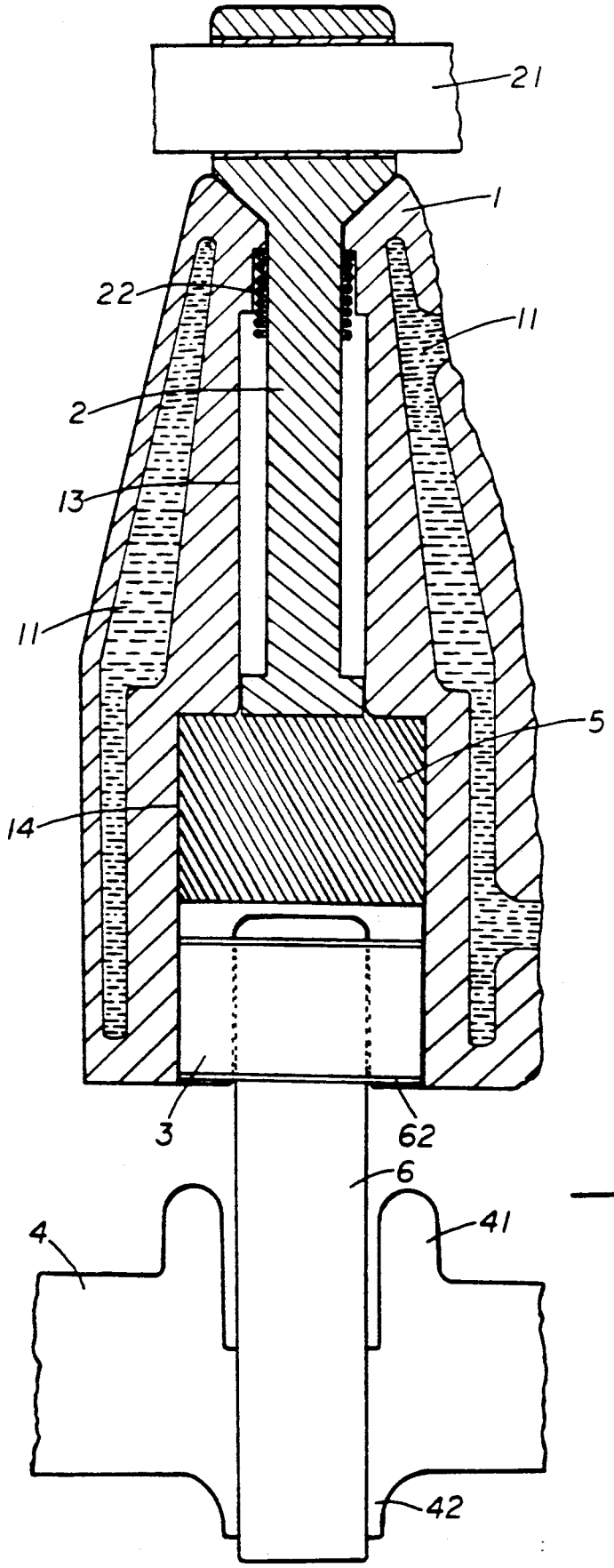
FIG. 2 is the front cutaway view of the hydraulic connecting rod of FIG. 1.
Figure 3:
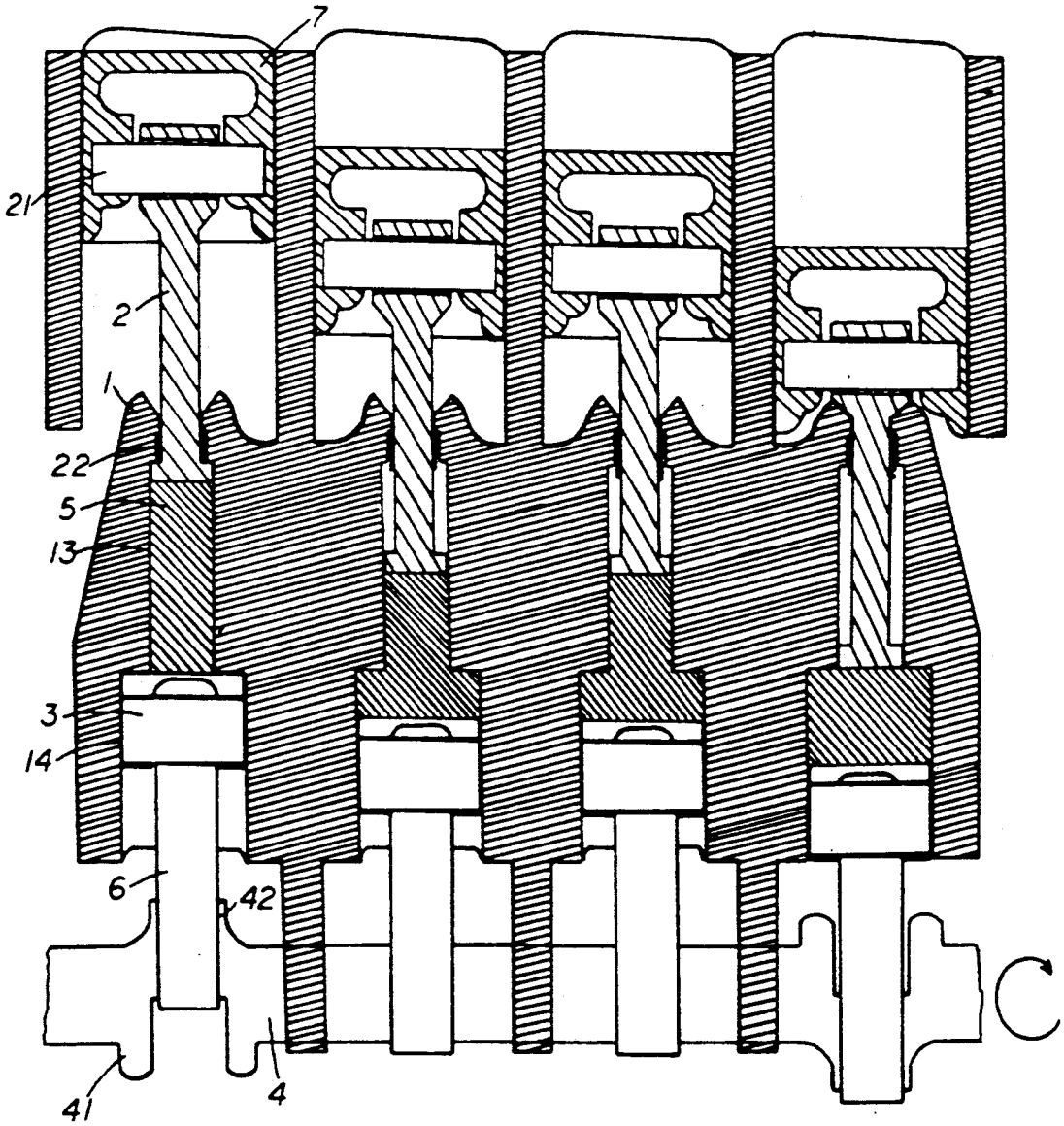
FIG. 3 is the front cutaway view of four connecting rods built in a four cylinder., in line, internal-combustion engine having the firing order 1-2-4-3.
Figure 4:
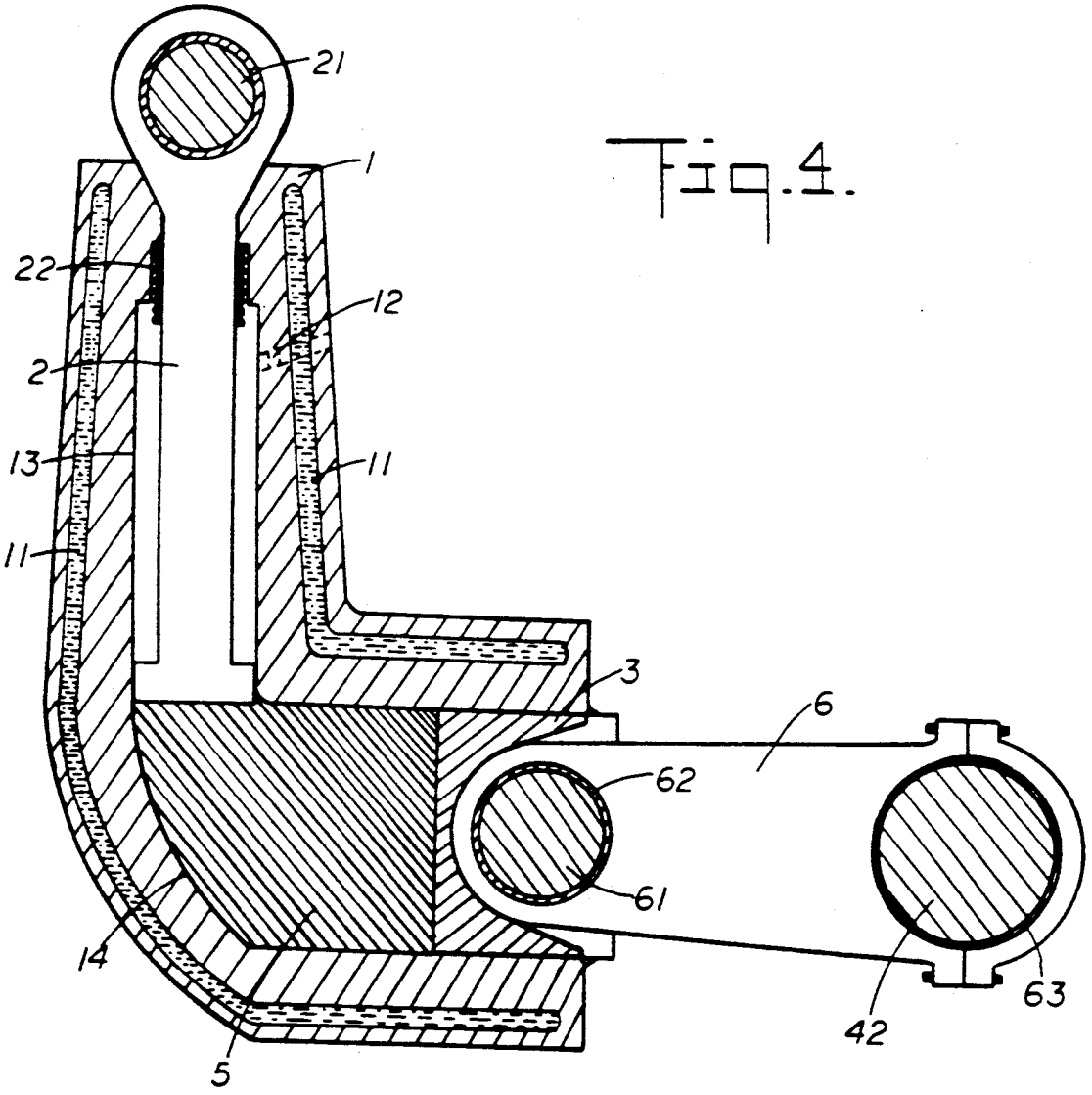
FIG. 4 is the side cutaway view of a half-horizontal hydraulic connecting rod according to the present invention.
Figure 5:
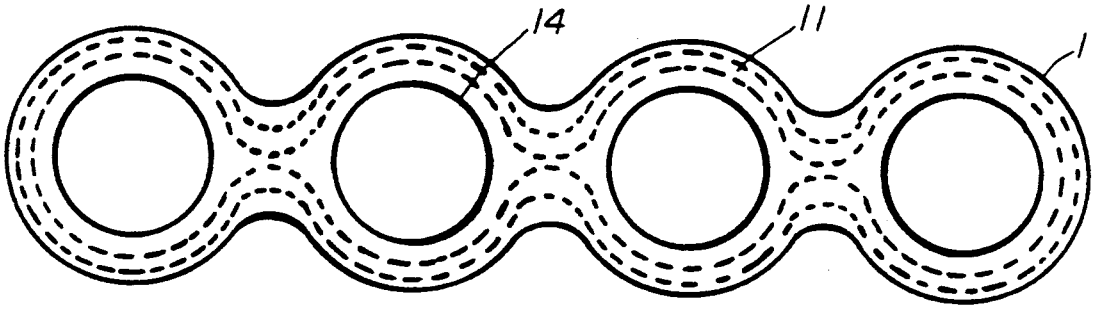
FIG. 5 is the bottom view of the four larger hydraulic cylinders' housing.
Figure 7:
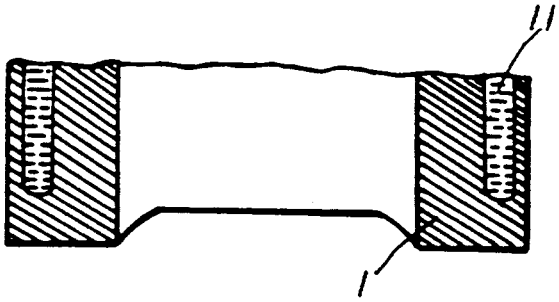
FIG. 7 is the front cutaway view of the larger hydraulic cylinder's bottom part.

As shown in FIGS. 1, 2, and 4, the bottom of the larger hydraulic piston 3 has two different lengths which suit the shape of the bottom part of the larger cylinder 14, shown in FIG. 7, and enable lower connecting rod 6 performance without increasing the total length of the hydraulic connecting rod. The length of the larger cylinder 14 and the larger piston 3 is extended on the sides which are parallel with the line of lower rod. 6 motion. The bottom part of the smaller piston 2 is shaped to fit the smaller cylinder 13 and the upper part of the smaller cylinder is shaped to fit the cylinder housing 1, as shown in FIG. 1, 2, 3, and 4.

The smaller cylinder 13 is, on its upper part, provided with the spring 22 which (when compressed by the bottom part of the smaller piston 2) enables smooth stopping of the engine piston 7 at its top dead center position by absorbing the inertia load of the engine piston 7 and the smaller hydraulic piston 2. The hydraulic cylinder housing 1 is also provided with water passages 11 for the purpose of cooling the cylinders 13 and 14, pistons 2 and 3 and hydraulic liquid 5. It is assumed that the surfaces of both cylinders 13 and 14 and pistons 2 and 3 are manufactured of a resistible material with good heat dissipation ability and in a shape which will cause the smallest possible leakage loss. However, according to the process of the present invention it is proposed that leakage loss of fluid 5 is compensated by the additional fluid from an external reservoir (not shown in FIGS.) through a one-way intake valve 12, built in the cylinder housing 1 as shown on FIGS. 1 and 4.

The process of the present invention will now be further described starting with the engine power stroke, wherein the engine piston 7 is pushed down by combustion pressure created inside the engine cylinder as a consequence of burning (ignition) of the air-fuel mixture. According to the process of the present invention, during its power stroke, the engine piston transmits the force caused by combustion pressure onto the smaller hydraulic piston 2.

Unlike prior art constructions in which the connecting rod connects the engine piston directly to the crankshaft, the transmission of combustion pressure according to the process of the present invention is in a straight line and, therefore, eliminates most of the piston-ring friction. This is significant since piston-ring friction accounts for ¾ of total friction in the engine and results in uneven wear of the engine cylinder walls. Uneven wear results in tapering of the cylinder wall which results in decreased combustion pressure and allows oil to enter and burn inside the engine cylinder. Because of the straight line motion of the engine piston of the present invention, (and consequent elimination of side thrust as discussed above), the engine piston 7 can have a more simple design and lower weight which will further decrease its inertia load. Furthermore, the engine piston 7 and the smaller hydraulic piston 2 can be manufactured as one solid part, if proven more efficient for the purpose of the present invention. Further, since the transmission of force exerted by the smaller piston 2 is also in a straight line, the piston 2 and the smaller cylinder 13 walls will not wear unevenly and will obviate problems associate with friction and tapered wear as discussed above.

The force exerted by the smaller hydraulic piston 2 on the hydraulic liquid 5 is (according to the law of hydraulics) increased proportionally to the pistons' diameter ratio, when exerted on the larger piston 3. Since the ratio between the areas of the smaller hydraulic piston 2 and the larger hydraulic piston 3, for the purpose of the present invention, is 1:2 the force exerted by the smaller piston will be increased by a factor of two when exerted on the larger piston 3. This force is then exerted on the crankshaft throw 42 via the lower rod 6 which is mounted on the pin 61 of the larger piston 3 (preferably via. a bearing 62) and on crankshaft throw 42 (preferably via a bearing 63). Since the displacement of fluid 5 from the smaller cylinder 13 causes the larger piston 3 to move only half as far as the smaller piston 2, the crankshaft throw 42 rotating diameter is only half of the crankshaft throw rotating diameter for a construction using a solid connection between the engine piston and crankshaft throw as in the prior art.

Assuming that doubled force transmitted by the lower rod 6 acts at the same angle and that crankshaft throw diameter is two times shorter, the torque of the crankshaft 4 equals the torque provided by the same combustion pressure using a prior art construction, assuming that no significant friction loss occurs during the piston's downward movement.

Since the crankshaft throw 42 rotation diameter is two times smaller than that of the connecting rod in the prior art, the centrifugal force which imposes a centrifugal load on one crankshaft throw bearing will be two times weaker and therefore enable a significant decrease in the length and weight of the crankshaft counterweights 41 (which are used to offset eccentric masses of metal in the crankshaft throws). The smaller centrifugal load and the smaller distance from the crankshaft rotating center will also enable crankshaft throws 42 to be lighter which will further reduce inertia load. Since inertia load decreases four times for a two times shorter crankshaft throw 42 and counterweight 41, the resultant load of combustion pressure will significantly increase. Knowing that centrifugal force significantly increases with crankshaft rotating speed and at high operating speed produces significant centrifugal load, it is obvious that the present invention will significantly improve performance of engines operating at high speed (rounds per minute). Further, since inertia load increases with any change in an engine's operating speed, it is also obvious that the engine will have better acceleration and smoother slow down procedure (deceleration and/or braking). Assuming that transmission of force (caused by combustion pressure) through the hydraulic fluid 5 will result in much smoother rotation of crankshaft 4 and that centrifugal and inertia loads will significantly decrease, it is logical to assume that flywheel weight will also decrease thus yielding in further improvement in engine performance.

As shown in FIG. 3, when the engine piston 7 reaches its bottom dead center position, all fluid 5 is displaced from the smaller cylinder 13 and the larger piston 3 also reaches its bottom dead center position. Assuming that the inertia load of the larger piston 3 is significantly smaller than the inertia load of the engine piston of a prior art construction, because of its smaller weight and two times lower speed and because most of the engine piston 7 and smaller piston 2 inertia loads are absorbed by the fluid 5, the inertia load imposed on the crankshaft throw bearing 63 at this point will also be significantly smaller. It is assumed that a significant increase of resultant load during the first 90 degrees of power stroke crankshaft throw rotation will not produce a bigger engine vibration because of smoother transmission of the force through the hydraulic fluid 5.

While performing its downward and upward stroke, the larger piston 3 will experience side thrust, i.e., it will be unevenly forced toward the left and right part of larger cylinder 14 wall, and these frictions will result in uneven wear of both the piston 3 the said cylinder 14. The problems associated with tapered wear will be significantly smaller than those associated with tapered wear produced by piston rings in an engine piston cylinder of conventional construction, because of the much lower temperature and better permanent lubrication of the cylinder walls by the hydraulic fluid 5.

As mentioned before, it is proposed that any leakage loss which occurs is compensated through the one-way intake valve 12 built in cylinder housing 1. During the exhaust stroke which follows the power stroke, the crankshaft throw 42 forces the lower rod 6 upwards and the force exerted on larger piston 3 displaces the fluid 5 into the smaller cylinder 13 which further causes the smaller piston 2 to perform its upward stroke. According to the laws of hydraulics, the force exerted by larger piston 3 is two times weaker when exerted on the smaller piston 2 and equals the force exerted by the connecting rod in the prior art. The smaller piston 2, which further exerts the force exerted on it onto the engine piston 7, has two times higher speed, i.e., moves two times faster, than the larger piston 3 as a consequence of displacement of the fluid 5 into smaller cylinder 13 with two times smaller cross sectional area. When the larger piston reaches its top dead center position, the entire fluid 5 is displaced into the smaller cylinder 13 and the smaller piston is forced to its top dead center. In order to stop the smaller piston 2 and the engine piston smoothly, the cylinder housing 1 is provided with a spring 22 which absorbs both cylinders' inertia loads, therefore, the inertia load imposed on the crankshaft throw bearing 63 is not influenced by the smaller piston's 2 and the engine piston's 7 inertia loads. As the crankshaft 4 rotates, the intake stroke begins such that the force exerted by the crankshaft throw 42 on the lower rod 6 forces the larger piston 3 to move downward. The larger piston's 3 downward stroke forces displacement of the fluid 5 into the larger cylinder 14, causing the smaller piston 2 to perform its downward stoke. The force of the spring 22 (which is pressed at top dead center of smaller piston 2) helps at the beginning of the smaller piston's 2 downward stroke. As the smaller piston 2 performs its downward stroke, it forces engine piston 7 to move downward and perform the intake stroke. When the pistons reach their bottom dead center position, the compression stroke is continued as described above for the exhaust stoke. The spring 22 again stops the smaller piston 2 and engine piston 7 in their top dead center positions by absorbing their inertia loads. Since these inertia loads are absorbed through the performance of the spring, the ignition point can be adjusted to give the best possible result of combustion pressure during the power stroke.

Figure 6:
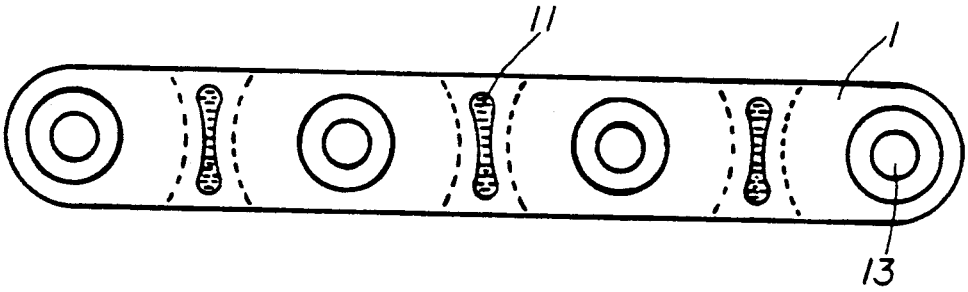
FIG. 6 is the top view of the four smaller hydraulic cylinders' housing.

As shown in FIG. 3, the hydraulic connecting rods for each engine cylinder are mounted in an engine cylinder block with its upper side shown in FIG. 6. This enables the connecting rods' housings to be held stationary and cooled by the water which circulates through the engine block, forced by the engine water pump. The water circulates through the water passages 11, shown in FIGS. 1, 2, 4, 5, and 6, according to the principle which will allow the most optimal performance according to the type of engine.

It is to be understood that the housings of the hydraulic connecting rods can be mounted on some other part of the engine block, if proven more suitable for the purpose of the present invention.

As shown in FIG. 4, the hydraulic connecting rod can be designed with its lower part having a horizontal position, in order to avoid any disadvantage caused by use of a significantly longer hydraulic connecting rod than the connecting rod in the prior art. While having the same operating process this hydraulic connecting rod transmits the force produced by combustion pressure on the crankshaft which is located on the left or right side of the engine cylinder. It is to be understood that the crankshaft for this version of hydraulic connecting rod can be located at any angle with respect to engine cylinder, proven the most suitable for the purpose of the present invention. The only difference in operating process of the two above described hydraulic connecting rods is that a connecting rod with its lower part in horizontal position requires more fluid 5 between the smaller 2 and larger 3 piston because its shape does not allow the entire amount of fluid 5 to be displaced from the larger cylinder 14.

According to the above-stated facts, it is obvious for those skilled in the art, that the present invention will eliminate most of piston-ring friction (which accounts for up to 70% of total friction in the engine) and will enable a more simple and lighter engine piston construction. Further, it will enable the engine piston and cylinder wall to be more durable and prevent loss of combustion pressure. Since the present invention will eliminate most of the centrifugal and inertia loads which cause combustion pressure force to decrease, the resultant load of combustion pressure force will significantly increase. Together with a decrease of engine vibration and lighter total rotating mass in the engine, this will significantly increase engine total power output. In the case of motor vehicles, improved engine acceleration and slow down procedure (deceleration) will result with improved acceleration and braking performance and, therefore, increased driving safety.

Having thus described the hydraulic connecting rod and its application to a multi-cylinder internal combustion engine, the operation of the hydraulic connecting and the advantages achieved thereby should now be apparent. In accordance with the present invention, the hydraulic connecting rod principles discussed above can be applied to a Stirling engine in the manner described in detail hereinafter.

Figure 10:
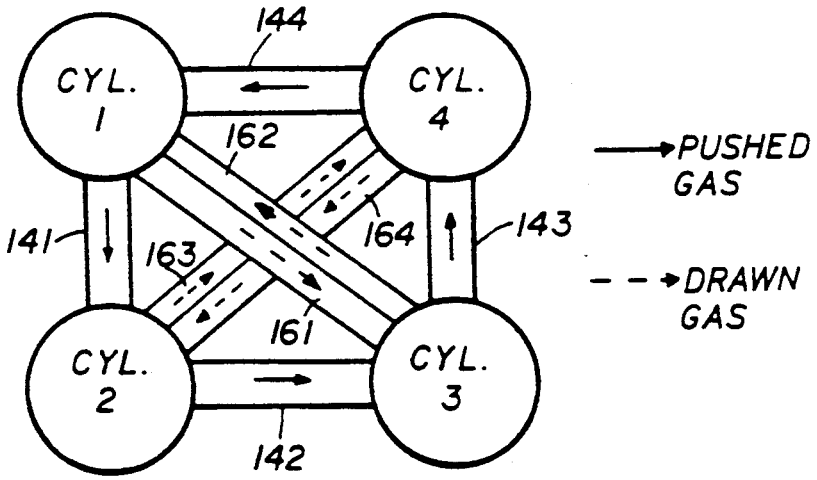
FIG. 10 is a top view of the Stirling engine of the present invention showing the arrangement of the engine cylinders and manifolds for a "square" arrangement.

The present invention provides a Stirling-type engine having a set of four cylinders, preferably in a "square" arrangement as shown in FIG. 10. Each cylinder includes a cylinder piston which is connected to a crankshaft by a hydraulic connecting rod. Two hydraulic connecting rods are connected to the same crankshaft and two crankshafts are connected to each other by a chain or toothed belt. For example, the connecting rods of the cylinders number 1 and 4 are connected to one crankshaft and the connecting rods of the cylinders 2 and 3 are connected to the second crankshaft. Since both crankshafts are connected, they act together and the rotating force can be further transmitted to an alternator from any of them or from a shaft which may be placed between the two crankshafts and connected to them.

Two crankshafts are preferably used for this embodiment because the process of the invention preferably uses vertically positioned cylinders and connecting rods. Also, since the transfer of force performed by a chain or toothed belt over the very short distance does not cause any energy loss, this mode is preferred to a "V" shaped engine with cylinders inclined toward one another or half-horizontal hydraulic connecting rods of the type shown in FIG. 4 which may also be used.

Figure 8:
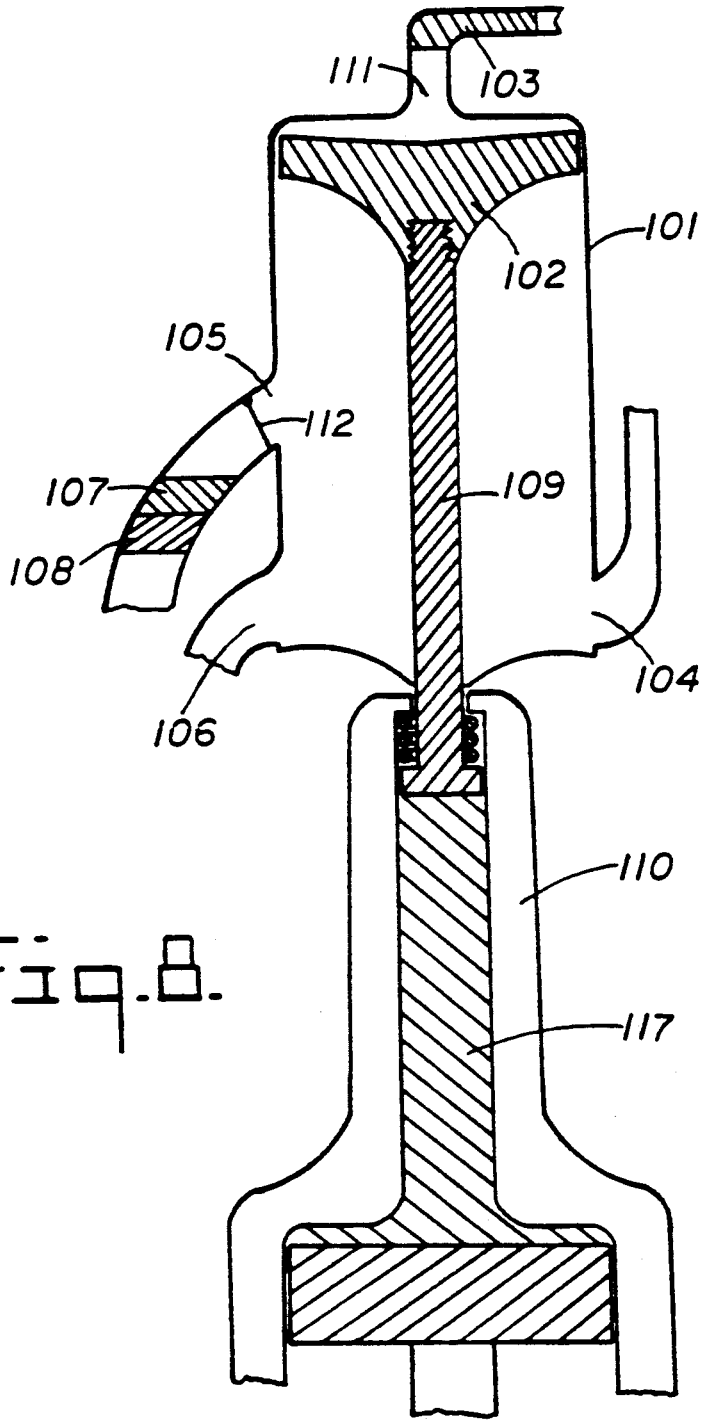
FIG. 8 is a cut-away view of the engine cylinder and upper part of the hydraulic connecting rod adapted for use in a Stirling engine.

As shown in FIG. 8, the engine cylinder 101 comprises a hot gas inlet port .111 inside the middle section of the cylinder head, an expanded gas outlet port 105 inside the cylinder wall, and two gas transfer ports 104 and 106. The expanded gas outlet port 105 is located below the cylinder midpoint and is provided with a one-way valve (reed valve) 112 which is operated by the pressure difference. The gas transfer ports (intake transfer port 106 and outlet transfer port 104) are located in the cylinder bottom. The gas inlet port 111 is provided with a gas heater 103 and the expanded gas outlet port 105 is provided with a gas cooler 107 and regenerator 108.

The cylinder piston 102 is connected and sealed to the smaller hydraulic piston 109 which transmits the force exerted by expanding gas on the piston 102 to the hydraulic fluid 117 inside the smaller hydraulic cylinder 110. Every downward (power) piston stroke is caused by the force exerted by the expanding gas and every upward stroke is caused by the crankshaft rotation. The power generating process of the engine piston 102 applies the same "hot gas-cooled gas" principle as a double-acting Stirling engine, but due to its more efficient process enables better utilization of the energy in the solar or generator heat and consequently better overall power output.

Figure 9:
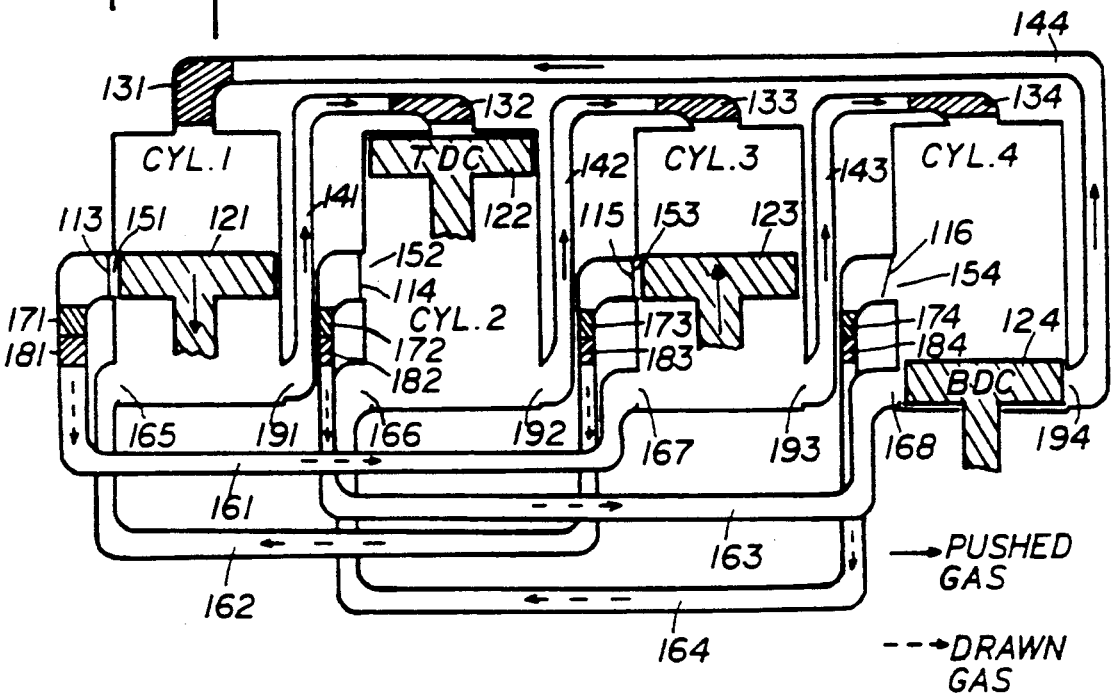
FIG. 9 is a cut-away view of the Stirling engine of the present invention showing all four engine cylinders, pistons, and manifolds.

As shown in FIG. 9, in accordance with the present invention, the four cylinders in the engine have multiple connections between their gas expanding and gas compressing areas. According to the process of the present invention, as shown in FIGS. 9 and 10, the pistons provide the gas to each other both through the compression and vacuum creating process. The four cylinders together with their connecting manifolds represent the sealed system which is filled by the required amount of a gas, such as helium, which is alternately heated and cooled to cause piston movement from which power can be generated. When the gas is heated it expands causing an increase in pressure, this increased pressure pushes the piston 102 downward and produces force. When the gas is cooled, it contracts causing a decrease in pressure. As a result of this decreased pressure, the gas does not produce force in the opposite direction which results in surplus of work.

When the gas is pushed through the heater 103, FIG. 8, its pressure increases and exerts force on the piston 102. This force causes the piston 102 to move downward and exert the same amount of force on the hydraulic fluid 117 inside the smaller hydraulic cylinder 110. As explained above in connection with the description of the hydraulic connecting rod, this force is further exerted on the crankshaft without producing unnecessary centrifugal and inertial losses.

When the piston 102 passes the midpoint of its power stroke, it uncovers the expanded gas outlet port 105 and hot (expanded) gas streams into this port. This occurs because the hot gas pressure is at this point much higher than the pressure inside the transfer manifold which extends from the hot gas outlet port 105. Simultaneously, the piston 102 presses against the cooled gas below and pushes this gas through the outlet transfer port 104 into the transfer manifold. The cooled gas pushed by the piston 102 passes through the heater 103 provided in the transfer manifold above the next cylinder and produces the pressure which acts on the piston in that cylinder. During its upward stroke which is caused by the crankshaft rotation, the piston 102 creates the vacuum which draws in the cooled gas from another cylinder.

The further description of the entire process of the present invention assumes that the pistons' positions are as shown in FIG. 9. FIG. 9 depicts the position of the pistons at one instant. The piston in cylinder number 1 (piston number 1) is at its midpoint travelling downwards. The piston in cylinder number 2 (piston number 2) is in its top dead center (TDC). The piston in cylinder number 3 (piston number 3) is at its midpoint travelling upwards and the piston in cylinder number 4 (piston number 4) is in its bottom dead center (BDC). The area above the piston number 1 is filled with hot gas and the area below this piston is filled with cooled gas. The area under the piston number 2 is filled with cooled gas. The gas in the area above the piston number 3 is at a low pressure gas (partial vacuum) and the gas in the area below this piston is also at a low pressure (partial vacuum). The gas in the area above the piston number 4 is also at a low pressure (partial vacuum).

Immediately after the instant depicted in FIG. 9, the piston number 1 (121) starts uncovering the expanded gas outlet port 151 and the hot gas which has a high pressure starts streaming into this port and the transfer manifold 161 connected to the cylinder number 3. The hot gas from the cylinder number 1 will stream into the transfer manifold 161 both because of its high pressure which significantly exceeds the pressure inside the manifold 161 and because of the partial vacuum created by the upward traveling piston 123 in the cylinder number 3. The hot gas from the cylinder number 1 passes through the cooler 171 and the regenerator 181 in the manifold 161 which decreases its pressure and causes this stream to continue due to the pressure difference.

Simultaneously, the piston number 1 (121) compresses the cooled gas below it and pushes this gas through the outlet transfer port 191 into the transfer manifold 141. The cooled gas pushed by the piston 121 passes through the heater 132 in the transfer manifold 141 and its pressure increases This produces force on the piston number 2 (122). The cooled gas below the piston 121 is pushed into the manifold 141 because the one way (reed) valve 115 in the hot gas outlet port 153 in the cylinder number 3 closes as soon as the pressure below the piston number 1 (121) exceeds the pressure above the piston number 3 (123).

It is to be understood that when, for example, the piston number 1 (121) starts its downward movement it will not push the cooled gas through the expanded gas outlet port 151 because of the following reasons: First, when the piston number 1 (121) starts travelling downwards, the piston number 3 (123) starts travelling upwards and no partial vacuum exists inside the cylinder number 3 at this point; second, the piston number 3 (123) will start creating the partial vacuum as it starts uncovering the cool air inlet port 167 but this vacuum will not produce an immediate effect; and finally, the pressure below the piston number 1 (121) is low at this point and, therefore, the gas will not stream out before its pressure increases (due to compression) which will not happen before the piston 121 reaches its midpoint. Accordingly, there is no reasonable possibility that any significant amount of cooled gas will be pushed back towards the cylinder number 3 before the piston 121 reaches its midpoint.

As the piston number 1 (121) reaches its BDC, the cooled gas below this piston is displaced into the cylinder number 2. Also, the hot gas above this piston 121 is drawn into the manifold 161 and the cylinder number 3. This drawn out gas is cooled so that it does not create any pressure inside the cylinder number 3. Since the piston number 4 (124) is now at its midpoint travelling upwards, the gas from the cylinder number 4 is not pushed into the cylinder number 1 and the area above the piston number 1 (121) again becomes a low pressure area. Therefore, the remaining gas will be compressed without causing any negative influence. This remaining gas will not escape into the manifold 144 because the heater 131 is located in this manifold and the piston number 4 (124) starts exerting pressure towards the cylinder number 1 when the piston number 1 (121) is at its midpoint travelling upwards.

As the piston number 3 (123) reverses its motion, it starts creating the pressure which causes the one-way valve 113 inside the hot gas outlet port 151 to close. This occurs when the piston number 1 (121) starts travelling upward and the piston number 3 (123) starts travelling downward and when almost all of the hot gas is drawn out of the cylinder number 1.

As is obvious from the above description and shown in FIG. 10, all four pistons are interconnected and act in concert with one another. Each piston performs the same process while being in a different position, i.e., out of phase, with respect to all other pistons. The pistons number 1 and 3 act in the opposite manner and the pistons number 2 and 4 act in the opposite manner. Therefore, the above description of the performance of pistons number 1 and 3 performance corresponds to the performance of pistons number 2 and 4.

The gas for the power stroke is supplied from the cylinder number 1 to the cylinder number 2, from the cylinder number 2 to the cylinder number 3, from the cylinder number 3 to the cylinder number 4, and from the cylinder number 4 to the cylinder number 1, as shown in FIGS. 9 and 10. The hot gas from the cylinder number 1 is drawn into the cylinder number 3 to be further pushed into the cylinder number 4. The hot gas from the cylinder number 2 is drawn into the cylinder number 4 to be pushed into the cylinder number 1. The hot gas from cylinder number 3 is drawn into cylinder number 1 to be pushed into cylinder number 2, and the hot gas from the cylinder number 4 is drawn into the cylinder number 2 to be pushed into the cylinder number 3.

Unlike Stirling cycle engines known in the prior art, the present invention uses the surplus of the hot gas pressure which cannot be exploited for any other useful purpose and both partial vacuum and pressure created by the pistons to transfer the gas from the expansion area back to the heaters. Since the gas passes through the cooler immediately after expansion, this transfer will not create any energy loss and a better work surplus will be created.

A significant aspect of the present information is that, unlike in the case of known double-acting Stirling engines, the physical configuration and the process of the present invention enables the heaters and coolers to be mounted on separate manifolds. Therefore, the heaters and coolers do not work in opposition to one another and consequently they will not diminish each others efficiency and will perform their duties in the most efficient manner. Moreover, the spatial separation of the heaters and coolers makes is possible to locate both the heater and cooler in an environment appropriate for their respective functions. For instance, the cooler could be located in water while the heaters were located above the water with a heat source (such as solar energy) focused directly onto their surface. Optimum engine performance is also achieved because the hot gas is not pushed back through the heaters which inevitably causes energy loss.

As known from the prior art, a Stirling cycle engine can be designed to use either air, hydrogen, helium, freon, or nitrogen. Since air and nitrogen appear to be limited to 20–25% of the power of a helium or hydrogen filled engine of the same displacement, helium and hydrogen are accepted as a better choice. Despite its excellent properties, such as the highest thermal conductivity and the lowest viscosity, hydrogen does not seem to be the best solution because it permeates through metals and is flammable Therefore, helium, which has a viscosity twice that of hydrogen but can be permanently contained and has a thermal conductivity which is nearly as good as hydrogen, is widely accepted as the best choice in this type of engine. It is thus believed that helium is the best choice for a working fluid in the engine of the present invention. Since the present invention enables less restricted flow of relatively inert helium, it will diminish related energy loss.

As is obvious from the present invention, in addition to the advantages provided by substituting the hydraulic connecting rod for the rhombic drive on the swashplate, the overall configuration of the engine of the present invention will provide a significantly more efficient engine than Stirling cycle engines known in the prior art.

It is to be understood that the present invention is not limited to use of helium and that the regenerators can be located anywhere along the transfer manifolds according to requirements for optimum engine performance. Also, any design for heaters and coolers can be used and the lubricating process of the entire engine can be performed by an oil pump which is powered by the crankshaft.

It is also to be understood that the present invention has been described in relation to a particular embodiment, herein chosen for the purpose of illustration and that the claims are intended to cover all changes and modifications, apparent to those skilled in the art which do not constitute a departure from the scope and spirit of the invention.

We claim:

1. A Stirling engine comprising:

a plurality of cylinders;

at least one piston located in each cylinder, each piston separating the cylinder into distinct chambers, and each piston being slidable within these cylinders so as to vary the volume of said chambers;

a plurality of fluid passages connecting the chambers of each cylinder to chambers of another cylinder; a working fluid sealed within the cylinders and fluid passages; a cooler for cooling the working fluid;

a heater for heating the working fluid;

a heater and cooler arranged so as to selectively heat the working fluid to increase the pressure of the working fluid and cool the working fluid to decrease the pressure of the working fluid so as to cause movement of the pistons within the cylinders;

a crankshaft;

and a hydraulic connecting rod for connecting at least one piston in each cylinder to the crankshaft, the hydraulic connecting rod comprising:

a fixed housing fixed with respect to the engine cylinder, the housing having first and second cylinders formed therein, the first and second cylinders being in fluid communication with one another and having a pre-determined diameter, the diameter of the first cylinder being less than the diameter of the second cylinder;

a small piston, the small piston comprising a head portion and a rod portion, the head portion being slidably received within the first cylinder in the housing and the rod portion being slidable into ad out of the housing, the rod portion having a first end connected to the head portion and a second end connected to the engine piston;

a large piston, the large piston having a piston head, the piston head being slidably received within the second cylinder;

a connecting rod connecting the large piston to the crankshaft;

the small piston and the large piston being spaced from one another so as to define a substantially fixed volume chamber bounded by the heads of the small and large piston and at least one of the first and second cylinders;

and an incompressible hydraulic fluid substantially filling the chambers so as to provide a fluid connection between the small piston and the large piston.

2. The Stirling engine of claim 1, wherein the heater and the cooler are spatially separated from one another a sufficient distance to allow the heater and cooler to be located in different environments.

3. The Stirling engine of claim 1, wherein the heater is located in one of the fluid passages and the cooler is located in a separate fluid passage.

4. The Stirling engine of claim 1 wherein the working fluid is helium.

5. The Stirling engine of claim 1, wherein the engine comprises four cylinders; a piston slidably received within each of the cylinder; and a plurality of passageways providing fluid communication between each cylinder and every other cylinder.

6. A Stirling engine comprising:

a first cylinder, a second cylinder, a third cylinder and a fourth cylinder, each of the cylinders having a piston slidably mounted therein;

a crankshaft;

a connecting device connecting each of the pistons to the crankshaft in a way which generates no significant side thrust on the piston within the cylinder;

each piston being moveable within each cylinder between a top dead center position and a bottom dead center position and each cylinder having cylindrical sidewalls and a top end and a bottom end;

each of the cylinders having a port formed at the top end, a port formed in the cylindrical side wall intermediate the top and bottom ends and two ports formed in the cylindrical side wall proximate the bottom end;

a first fluid passageway extending from one of the ports formed proximate the bottom end of the fourth cylinder to the port formed at the top of the first cylinder, a heater provided in said passageway;

a second passageway extending between one of the ports formed proximate the bottom end of the first cylinder and the port formed at the top of the second cylinder, a heater provided in said passageway;

a third passageway extending between one of the ports formed proximate the bottom of the second cylinder and the port formed at the top of the third cylinder, a heater provided in said passageway;

a fourth passageway extending between one of the ports formed proximate the bottom of the third cylinder, and the port formed at the top of the fourth cylinder, a heater provided in said passageway;

a fifth passageway formed between the port formed intermediate the top and bottom ends of the first cylinder and the other port formed proximate the bottom of the third cylinder;

a sixth passageway extending between the port formed intermediate the top and bottom ends of the second cylinder and the other port formed proximate the bottom of the fourth cylinder;

a seventh passageway extending between the port formed intermediate the top and bottom ends of the third cylinder and the other port formed proximate the bottom of the first cylinder;

an eighth passageway extending between the port formed intermediate the top and bottom ends of the fourth cylinder and the other port formed proximate the bottom end of the second cylinder;

a cooler and a regenerator provided in each of the fifth, sixth, seventh and eighth passageways; a one-way valve mounted in each of said fifth, sixth, seventh and eighth passageway so as to allow passage of fluid from the port formed intermediate the top and bottom ends of the cylinders to the port formed proximate the bottom end of the cylinder, but preventing flow in the opposite direction; a working fluid sealed within the engine.

7. The Stirling engine of claim 5, wherein the connecting device is a hydraulic connecting rod.

8. The Stirling engine of claim 6 wherein, the connecting device is a hydraulic connecting rod connecting the pistons to the crankshaft, the hydraulic connecting rod comprising: a housing, the housing having first and second cylinders formed therein, the first and second cylinders being in fluid communication with one another and each having a predetermined diameter, and the diameter of the first cylinder being less than the diameter of the second cylinder; a small piston, the small piston comprising a head portion and a rod portion, the head portion being slidably received within the first cylinder in the housing and the rod portion being slidable into and out of the housing, the rod portion having a first end connected to the head portion and a second end connected to the engine piston; a large piston, the large piston having a piston head, the piston head being slidably received within the second cylinder; a connecting rod connecting the large piston to the engine crankshaft; the small piston and the large piston being spaced from one another so as to define a substantially fixed volume chamber bounded by the heads of the small and large piston and at least one of a first and second cylinders; an incompressible hydraulic fluid substantially filling the chamber so as to provide a fluid connection between the small piston and the large piston.

9. The Stirling engine of claim 6, wherein the working fluid is helium.

10. The Stirling engine of claim 6, wherein each of the heaters is provided above the top end of the cylinders and each of the coolers and regenerators are provided below the ports formed intermediate the top and the bottom ends of the cylinders.

11. A Stirling engine comprising at least four cylinders; a piston slidably received within each of the cylinders; a plurality of passageways providing direct fluid communication between each cylinder and every other cylinder; a working fluid sealed within the engine; and means for heating and cooling the working fluid so as to cause expansion and contraction of the working fluid, the pistons being moveable within the cylinders in response to the expansion and contraction of the fluid; and a connection device connecting each of the pistons to a crankshaft.

12. The Stirling engine of claim 11, wherein the connecting device is a hydraulic connecting rod.

13. The Stirling engine of claim 12, wherein the hydraulic connecting rod comprises a housing, the housing having first and second cylinders formed therein, the first and second cylinders being in fluid communication with one another and each having a pre-determined diameter, the diameter of the first cylinder being less than the diameter of the second cylinder; a small piston, the small piston comprising a head portion and a rod portion, the head portion being slidably received within the first cylinder in the housing and the rod portion being slidable into and out of the housing, the rod portion having a first end connected to the head portion and a second end connected to the engine piston; a large piston, the large piston having a piston head, the piston head being slidably received within the second cylinder, a connecting rod connecting the large piston to the engine crankshaft; the small piston and the large piston being spaced from one another so as to define a substantially fixed volume chamber bounded by the heads of the small and large piston and at least one of the first and second cylinders; and an incompressible hydraulic fluid substantially filling the chamber so as to provide a fluid connection between the small piston and the large piston.

14. The Stirling engine of claim 11, further comprising means for gathering solar heat and focusing it on the heaters.

15. The Stirling engine of claim 11, further comprising a coolant bath in which the coolers are immersed.

16. The Stirling engine of claim 15, wherein the coolant bath is running water.

17. The Stirling engine of claim 11, wherein the working fluid is helium.

18. The Stirling engine of claim 11, wherein the heaters are located above the top end of the cylinders and the coolers and regenerators are located below the top end of the cylinders.

* * * * *